United States Patent [19]

Berman

[11] 4,195,234

[45] Mar. 25, 1980

[54] INFRARED INTRUSION ALARM SYSTEM WITH TEMPERATURE RESPONSIVE THRESHOLD LEVEL

[75] Inventor: Herbert L. Berman, Los Altos Hills, Calif.

[73] Assignee: Optical Coating Laboratory, Inc., Santa Rosa, Calif.

[21] Appl. No.: 874,380

[22] Filed: Feb. 2, 1978

[51] Int. Cl.[2] ..... H01J 39/00; H01H 47/24

[52] U.S. Cl. ..... 307/117; 340/567

[58] Field of Search ..... 307/117; 356/216; 73/355 R, 355 EM; 340/567, 578, 579; 323/68, 69; 330/289; 361/165

[56] References Cited

U.S. PATENT DOCUMENTS

| | | | |
|---|---|---|---|
| 3,703,718 | 11/1972 | Berman | 340/567 |
| 3,792,366 | 2/1974 | Jornod | 330/289 |
| 3,928,843 | 12/1975 | Sprout et al. | 340/567 |
| 3,988,726 | 10/1976 | Reiss et al. | 340/567 |
| 4,052,716 | 10/1977 | Mortensen | 340/567 X |

*Primary Examiner*—L. T. Hix
*Assistant Examiner*—James L. Dwyer
*Attorney, Agent, or Firm*—Flehr, Hohbach, Test, Albritton & Herbert

[57] ABSTRACT

Intrusion detector of the type in which the presence of an intruder is detected by infrared heat energy emitted by his body. An alarm signal is delivered when the level of radiation detected rises from the ambient level to a threshold level. A temperature responsive circuit adjusts the threshold level and so that the system has a relatively uniform detection range or sensitivity notwithstanding changes in the ambient temperature in the protected area.

8 Claims, 3 Drawing Figures

FIG-1
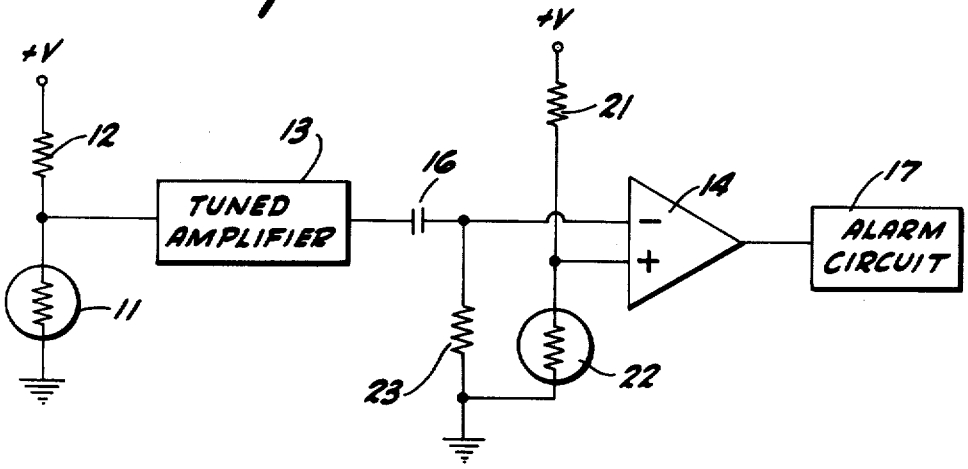
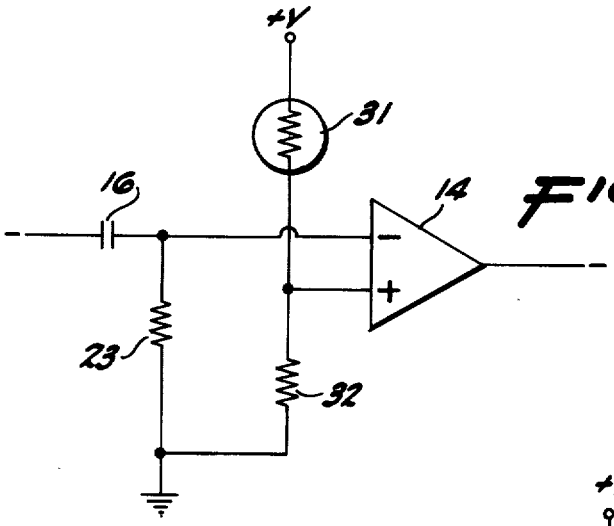
FIG-2
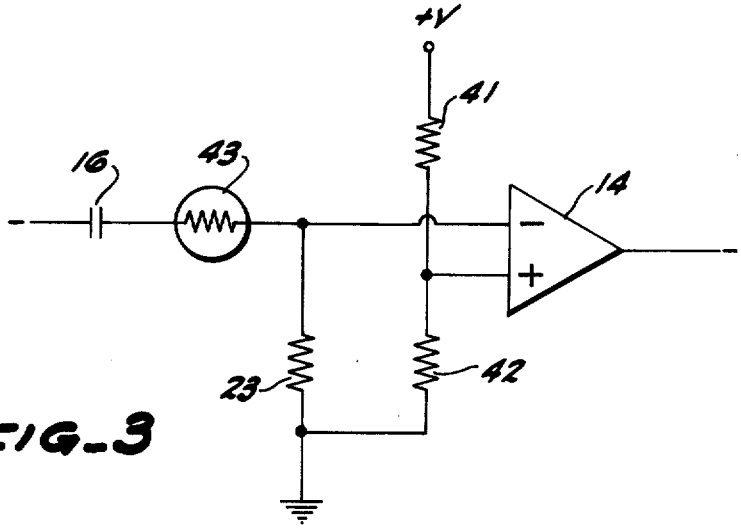
FIG-3

INFRARED INTRUSION ALARM SYSTEM WITH TEMPERATURE RESPONSIVE THRESHOLD LEVEL

BACKGROUND OF THE INVENTION

This invention pertains generally to intrusion alarm systems and more particularly to a system in which the presence of an intruder is detected by infrared heat energy emitted by his body.

Infrared intrusion alarms systems heretofore provided generally utilize means including a sensing element for producing an electrical signal corresponding to the level of infrared energy received from an area to be protected. The signal is processed by suitable circuitry, and an alarm is actuated in the event of an abrupt change in the signal, as occurs when a warm-bodied intruder enters the protected area. Systems of this type are described in U.S. Pat. Nos. 3,703,718 and 3,928,843.

Such systems depend for their operation upon the difference or contrast in level between the radiation emitted by an intruder and the radiation produced by background objects which are normally present in the protected area, and the sensitivity or detection range of such systems is therefore dependent upon ambient temperature. For the small temperature differences which normally exist between the intruder and the background objects, the contrast signal is very nearly proportional to the difference in temperature between the intruder and the background. As the temperature of the protected area increases and approaches the temperature of the intruder, the contrast signal decreases, and the detection range is reduced. Conversely, when the temperature of the protected area decreases, the contrast signal increases, and the detection range also increases. However, if the background temperature is lowered significantly, the detection system may be subject to false alarms from spurious thermal sources within the protected area.

SUMMARY AND OBJECTS OF THE INVENTION

The invention provides a passive infrared intrusion detector which has a relatively uniform detection range or sensitivity notwithstanding ambient temperature changes in the protected area. The system includes a sensing element responsive to infrared energy impinging thereon, circuit means connected to the sensing element for providing an electrical signal in response to abrupt changes in the level of infrared energy in the protected area, means responsive to the electrical signal for delivering an output signal when the electrical signal reaches a threshold level and means responsive to the ambient temperature in the protected area for adjusting the threshold level to maintain a substantially constant sensitivity notwithstanding changes in the ambient temperature.

It is in general an object of the invention to provide a new and improved infrared intrusion alarm system.

Another object of the invention is to provide an alarm system of the above character having temperature responsive means for maintaining a substantially constant sensitivity notwithstanding changes in ambitent temperature in the protected area.

Additional objects and features of the invention will be apparent from the following description in which the preferred embodiments are set forth in detail in conjunction with the accompanying drawings.

BRIEF DESCRIPTION OF THE DRAWINGS

FIG. 1 is a circuit diagram, partly in block form, of one embodiment of an intrusion alarm system according to the invention. FIG. 2 is a fragmentary circuit diagram of a second embodiment of an alarm system according to the invention.

FIG. 3 is a fragmentary circuit diagram of a third embodiment of an alarm system according to the invention.

DESCRIPTION OF THE PREFERRED EMBODIMENTS

As illustrated in FIG. 1, the alarm system includes a sensing element 11 which receives infrared radiation from the area to be protected. In the preferred embodiment, this element is a thermistor bolometer having a resistance dependent upon the level of infrared radiation impinging thereon, and radiation from a plurality of discrete fields of view is directed to the sensing element by a plurality of mirror segments (not shown). If desired, other suitable types of sensing elements such as pyroelectric and thermopile devices can be utilized in place of the thermister bolometer.

Sensing element 11 is connected electrically in series with a resistor 12 between a voltage source +V and the system ground. The sensing element and resistor serve as a voltage divider, with the voltage at the junction of the two being dependent upon the level of infrared radiation impinging upon the sensing element.

The junction of sensing element 11 and resistor 12 is connected to the input of a tuned amplifier 13. This amplifier preferably has a pass band on the order of 0.2 to 2 Hz, with a peak frequency on the order of 0.5 HZ. This frequency response corresponds to the rate at which a person walks, and it has been found to be particularly suitable for discriminating between changes in the level of infrared radiation produced by an intruder and gradual changes such as room or ambient temperatue changes. Suitable circuits for the tuned amplifier are found in the aforesaid U.S. Pat. Nos. 3,703,718 and 3,928,843. In the absence of an abrupt change in the energy level, the output of the amplifier remains substantially constant at a fixed level such as zero. An abrupt change in the energy level produces a corresponding change in the output of the amplifier, with the magnitude of the change in output being dependent on the magnitude of the change in the energy level.

The output of the tuned amplifier is connected to one input of a level detector 14 by means of a capacitor 16. The level detector comprises an operational amplifier, and the signal from amplifier 13 is applied to the inverting input of this amplifier. The output of the level detector is connected to an alarm circuit 17.

Means is provided for applying a temperature dependent reference signal to level detector 14 in order to maintain a substantially constant sensitivity. This means includes a fixed resistor 21 and a thermistor 22 connected in series between voltage source +V and ground. The junction of the resistor and thermistor is connected to the non-inverting input of amplifier 14. The thermistor is a temperature dependent resistive element having a relatively large negative temperture coefficient. If desired, other suitable types of temperature responsive elements can be employed. Resistor 21 and thermistor 22 serve as a voltage divider which delivers a temperature dependent reference voltage to the level detector. A resistor 23 is connected between inverting input of the level detector and ground. In order to maintain a predetermined minimum reference level notwithstanding extreme temperature increases an additional fixed resistor (not shown) can be connected in series between thermistor 22 and ground.

Operation and use of the embodiment of FIG. 1 can be described briefly. In the absence of an intruder in the protected area, amplifier 13 delivers an output signal of zero volts. When an intruder enters the area, the signal increases accordingly. In level detector 14, this signal is compared with the reference signal provided by the voltage divider comprising resistor 21 and thermistor 22. The reference signal varies in level in accordance with changes in temperature in the protected area. Thus, as the temperature increases, the resistance of the thermistor decreases, and the reference voltage likewise decreases. Conversely, as the temperature decreases, the resistance of the thermistor increases, and the reference voltage increase accordingly. As a result, the level of the contrast or amplifier output signal required to produce an alarm remains substantially constant. This means that the sensitivity or detection range of the system tends to remain relatively constant over wide variations in the temperature of the protected area. therefore, the detection range is not substantially decreased by increases in temperature, and false alarms from spurious thermal sources are avoided when the temperature decreases.

The embodiment illustrated in FIG. 2 is generally similar to that of FIG. 1. In FIG. 2, however, a temperature dependent resistive element 31 is connected between source +V and the non-inverting input of level detector 14, and a fixed resistor 32 is connected between this input and ground. Element 31 has a relatively large positive temperature coefficient so that as temperature increases, the resistance of element 31 increases and the voltage developed across resistor 32 decreases. Conversely, as the temperature decreases, the resistance of element 31 decreases and the voltage developed across resistor 32 increases. Thus, the desired relatively constant sensitivity is again maintained.

In the embodiment of FIG. 3, a reference signal of constant magnitude is applied to level detector 14 by a voltage divider consisting of fixed resistors 41, 42. A temperature dependent resistive element 43 is connected in series between capacitor 16 and the input of the level detector. Element 43 has a relatively large negative temperature coefficient and forms a voltage divider with resistor 23 which serves to attenuate the signal from amplifier 13. As temperature increases, the resistance of element 43 decreases, and the signal applied to the level detector from amplifier 13 increases in level. Conversely, when temperature decreases, the resistance of element 43 increases, and the applied signal decreases in level. Thus, in this embodiment, a relatively constant sensitivity is maintained by adjusting the ambient signal in accordance with temperature variations.

It is apparent from the foregoing that a new and improved alarm system has been provided. While only certain presently preferred embodiments have been described, as will be apparent to those familiar with the art, certain changes and modifications can be made without departing from the scope of the invention as defined by the following claims.

What is claimed is:

1. In a system for detecting the presence of an intruder in a protected area by a change in infrared energy from an ambient level to a threshold level: means including a sensing element for providing an electrical signal in response to a change in the infrared energy, means for providing a reference signal corresponding to the threshold level, means responsive to the electrical signal and the reference signal for delivering an output signal when the energy in the protected area reaches the threshold level, and means responsive to the ambient temperature in the protected area for adjusting the level of the reference signal to maintain a substantially constant sensitivity notwithstanding changes in the ambient temperature.

2. The system of claim 1 wherein the means for providing a reference signal comprises a voltage divider having a temperature dependent resistive element in one leg thereof.

3. In a system for detecting the presence of an intruder in a protected area by a change in infrared energy from an ambient level to a threshold level: means including a sensing element for providing an electrical signal in response to a change in the infrared energy, means for providing a reference signal corresponding to the threshold level, means responsive to the electrical signal for delivering an output signal in the event that the electrical signal reaches the level of the reference signal, and means responsive to the ambient temperature in the protected area for increasing the level of the reference signal when the temperature decreases and decreasing the level of the reference signal when the temperature increases.

4. The system of claim 3 wherein the means for providing a reference signal comprises a voltage divider having a temperature dependent resistive element in one leg thereof.

5. In a system for detecting the presence of an intruder in a protected area by a change in infrared energy from an ambient level to a threshold level: means including a sensing element for providing an electrical signal in response to a change in the infrared energy, means for providing a reference signal, means for delivering an output signal in the event that the electrical signal reaches the level of the reference signal, and means responsive to ambient temperature in the protected area for attenuating the electrical signal to maintain a substantially uniform sensitivity notwithstanding changes in the ambient temperature.

6. The system of claim 5 wherein the temperature responsive means comprises a temperature dependent resistive element through which the electrical signal passes.

7. In a system for detecting the presence of an intruder in a protected area by a change in the level of infrared energy in said area: means including a sensing element for providing an electrical signal corresponding to infrared energy impinging on said sensing element, amplifier means responsive to the electrical signal for delivering a contrast signal corresponding to a change in the level of the infrared energy, a reference signal source, comparator means responsive to the contrast signal and the reference signal for delivering an output signal in the event that the contrast signal reaches the level of the reference signal, and means responsive to the ambient temperature in the protected area for adjusting the level of the reference signal to maintain a substantially constant sensitivity notwithstanding changes in the ambient temperature.

8. The system of claim 7, wherein the reference source comprises a voltage divider and the means for adjusting the level of the reference comprises a temperature dependent resistive element in one leg of the voltage divider.

* * * * *